US011447922B2

(12) United States Patent
Currey

(10) Patent No.: US 11,447,922 B2
(45) Date of Patent: Sep. 20, 2022

(54) VIBRATORY COMPACTOR

(71) Applicant: Albert Ben Currey, Phoenix, AZ (US)

(72) Inventor: Albert Ben Currey, Phoenix, AZ (US)

( * ) Notice: Subject to any disclaimer, the term of this patent is extended or adjusted under 35 U.S.C. 154(b) by 0 days.

(21) Appl. No.: 17/647,241

(22) Filed: Jan. 6, 2022

(65) Prior Publication Data

US 2022/0127808 A1 Apr. 28, 2022

Related U.S. Application Data

(63) Continuation-in-part of application No. 17/397,369, filed on Aug. 9, 2021, which is a continuation of application No. 16/989,373, filed on Aug. 10, 2020, now Pat. No. 11,085,159, which is a continuation of application No. 16/691,240, filed on Nov. 21, 2019, now Pat. No. 10,738,434.

(51) Int. Cl.

| | |
|---|---|
| ***E02D 3/046*** | (2006.01) |
| ***E02F 3/96*** | (2006.01) |
| ***B06B 1/18*** | (2006.01) |
| ***E02F 5/22*** | (2006.01) |
| ***E01C 19/30*** | (2006.01) |

(52) U.S. Cl.

CPC ..... *E02D 3/046* (2013.01); *B06B 1/183* (2013.01); *E01C 19/30* (2013.01); *E02F 3/967* (2013.01); *E02F 5/223* (2013.01); *B06B 2201/73* (2013.01)

(58) Field of Classification Search

CPC ..... E01C 19/30; E01C 19/32; E01C 19/34; E01C 19/35; E02D 3/046

See application file for complete search history.

(56) References Cited

U.S. PATENT DOCUMENTS

| | | | | |
|---|---|---|---|---|
| 3,128,682 | A | 4/1964 | Thompson | |
| 9,926,677 | B1 * | 3/2018 | Beckhusen | E02F 3/967 |
| 9,938,672 | B2 | 4/2018 | Jordan | |
| 9,988,770 | B1 | 6/2018 | Jordan | |
| 10,738,434 | B1 | 8/2020 | Currey | |

FOREIGN PATENT DOCUMENTS

| | | |
|---|---|---|
| CN | 209368918 | 9/2019 |
| FR | 888976 A | * 12/1943 |
| JP | H11158860 | 6/1996 |
| KR | 20110111681 | 10/2011 |

* cited by examiner

*Primary Examiner* — Sunil Singh

(74) *Attorney, Agent, or Firm* — Schmeiser, Olsen & Watts, LLP

(57) ABSTRACT

A vibratory compactor is provided. The vibratory compactor may include a compactor plate, a frame coupled to the compactor plate, wherein the frame may include an inner space and a housing. The frame may include a plurality of mounting brackets coupled between a first side member and a second side member of the frame. The vibratory compactor may include a vibration generation device coupled to the compactor plate within the inner space of the frame. The vibratory compactor may include a plurality of isolators, each isolator coupled to one mounting bracket of the plurality of mounting brackets. The housing may be coupled to the plurality of isolators, wherein the housing may include couplers removably coupled to a top surface of the housing. The couplers may be configured for coupling the vibratory compactor to an excavator type vehicle.

11 Claims, 15 Drawing Sheets

VIBRATORY COMPACTOR

CROSS REFERENCE TO RELATED APPLICATION[s]

This application is a continuation-in-part of U.S. patent application Ser. No. 17/397,369, filed on Aug. 9, 2021, which is a continuation of U.S. patent application Ser. No. 16/989,373, filed on Aug. 10, 2020, now U.S. Pat. No. 11,085,159, issued Aug. 10, 2021, which is a continuation of U.S. patent application Ser. No. 16/691,240, filed on Nov. 21, 2019, now U.S. Pat. No. 10,738,434, issued Aug. 11, 2020, the disclosures of which are incorporated entirely herein by reference.

BACKGROUND OF THE INVENTION

Technical Field

This invention relates generally to a compactor and more particularly to a vibratory compactor for use with excavator type vehicles.

State of the Art

Vibratory plate compactors are designed to compact lose material, such as soil, gravel, small aggregate, asphalt and so forth. Conventional plate compactors include a heavy plate on the bottom of the machine that moves up and down quickly. The combination of rapid impacts, plate weight and impact forces the soil underneath to compact or pack together more tightly. These plate compactors can be powered by gas engines or by hydraulic motors. Plate compactors that operate with hydraulic fluid are typically used with excavators or back hoes as an attachment. However, these hydraulic plate compactors are limited in their capability because the exposed hoses and further are not true vibratory compactors but have cyclic up and down motions wherein the amplitude of the up and down motion and the weight of the plate combine for the compaction. Often, these vibratory compactors cannot and should not have extra forces applied by the arm of the excavator or backhoe, but rather rest on the surface and the plate performs the function.

Accordingly, there is a need for an improved vibratory compactor for use with excavator type vehicles.

SUMMARY OF THE INVENTION

An embodiment includes a vibratory compactor comprising: a compactor plate; a frame having a front member and a rear member coupled directly to the compactor plate, wherein the frame comprises: an inner space within the frame; more than one mounting bracket coupled within the inner space of the frame; and an elongate aperture formed in each the front member and the rear member; a hydraulic vibration generation device coupled to the compactor plate within the inner space of the frame; and a housing having a front member and a rear member coupled to the frame by at least one isolator, the frame located within an inner volume of the housing and forming a gap between the frame and the housing, wherein: the housing further comprises a control member through an aperture in the front member of the housing and a control member coupled through an aperture in the rear member of the housing; the control member in the front member of the housing extends within the elongate aperture in the front member of the frame and the control member in the rear member of the housing extends within the elongate aperture in the rear member of the frame when the housing is coupled to the frame; and the control members and the elongate apertures are configured to control movement of the housing with respect to the frame.

Another embodiment includes a method of operating a vibratory compactor comprising: coupling the vibratory compactor to a vehicle, the vibratory compactor comprising a compactor plate coupled to a frame, a hydraulic vibration generation device coupled to the compactor, and a housing coupled around the frame with at least one isolator; operating the vibration generation device to vibrate the compactor plate and the frame; applying force to the compactor plate from the vehicle in response to the excavator type vehicle applying force to the housing; compacting material contacted by the compactor plate; and inhibiting movement of housing with respect to the frame in response to the compactor plate or frame being restricted with lifting the vibratory compactor.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
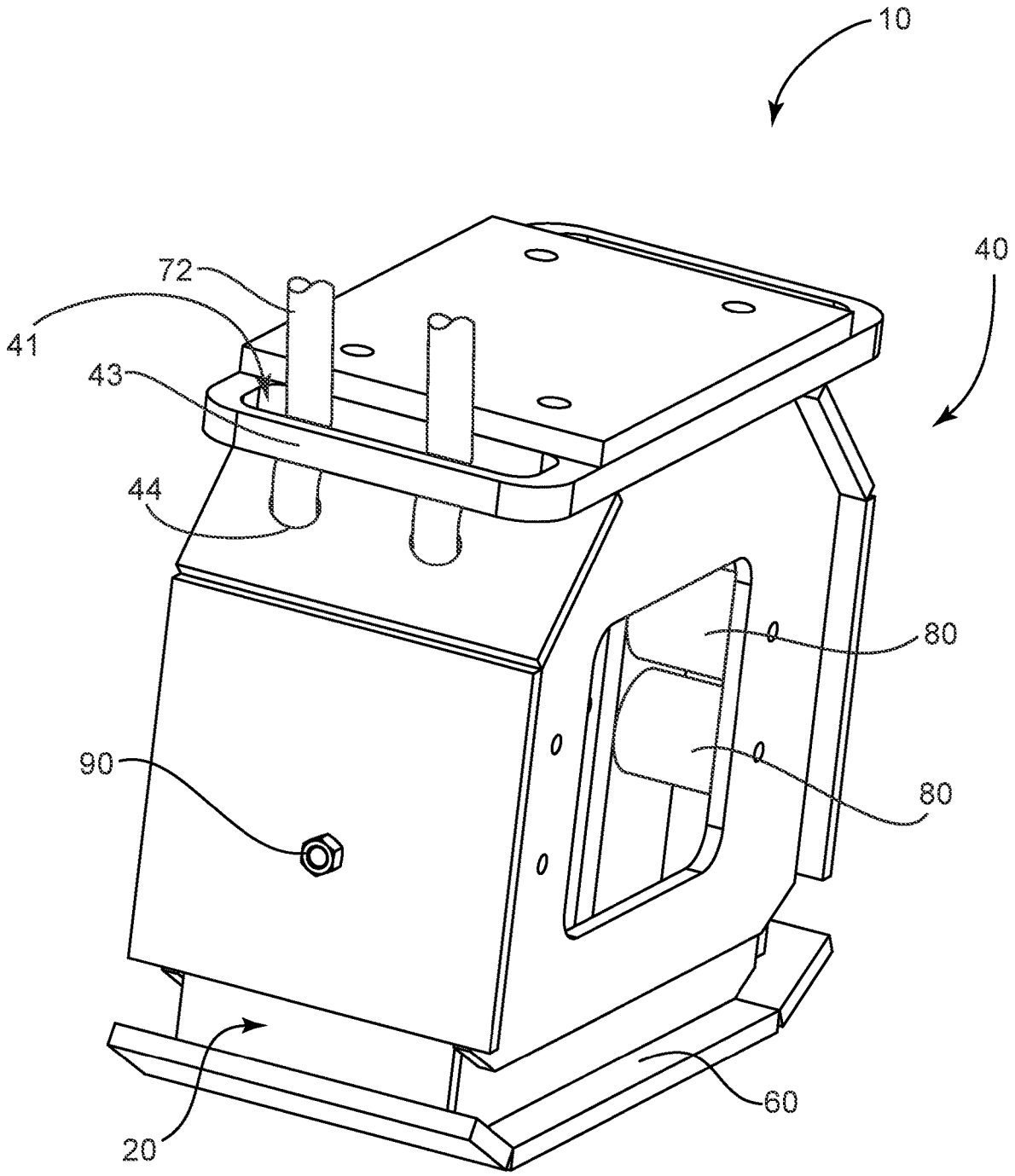
FIG. 1 is a perspective view of a vibratory compactor in accordance with an embodiment.
Figure 2:
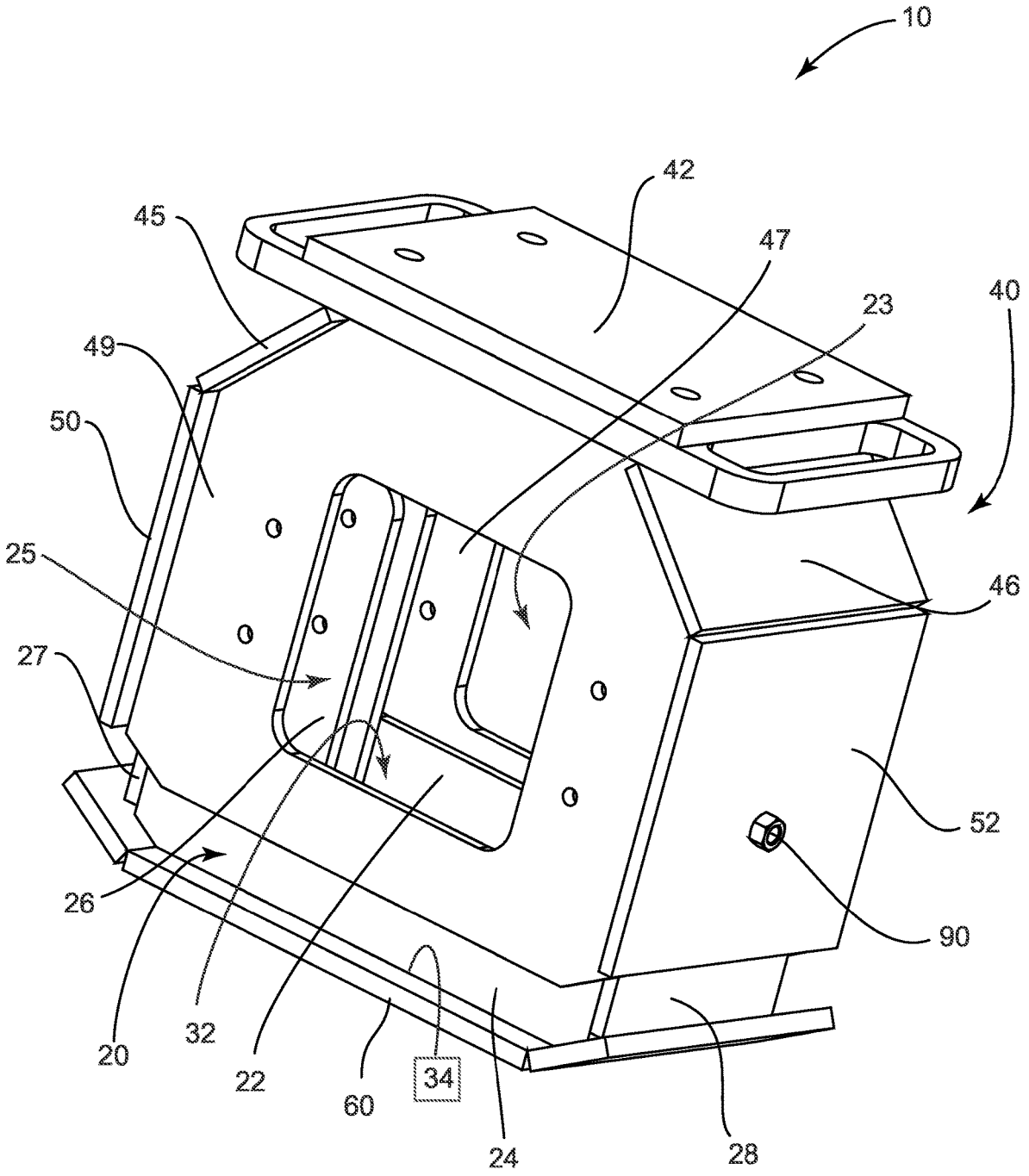
FIG. 2 is another perspective view of a vibratory compactor in accordance with an embodiment.
Figure 3A:
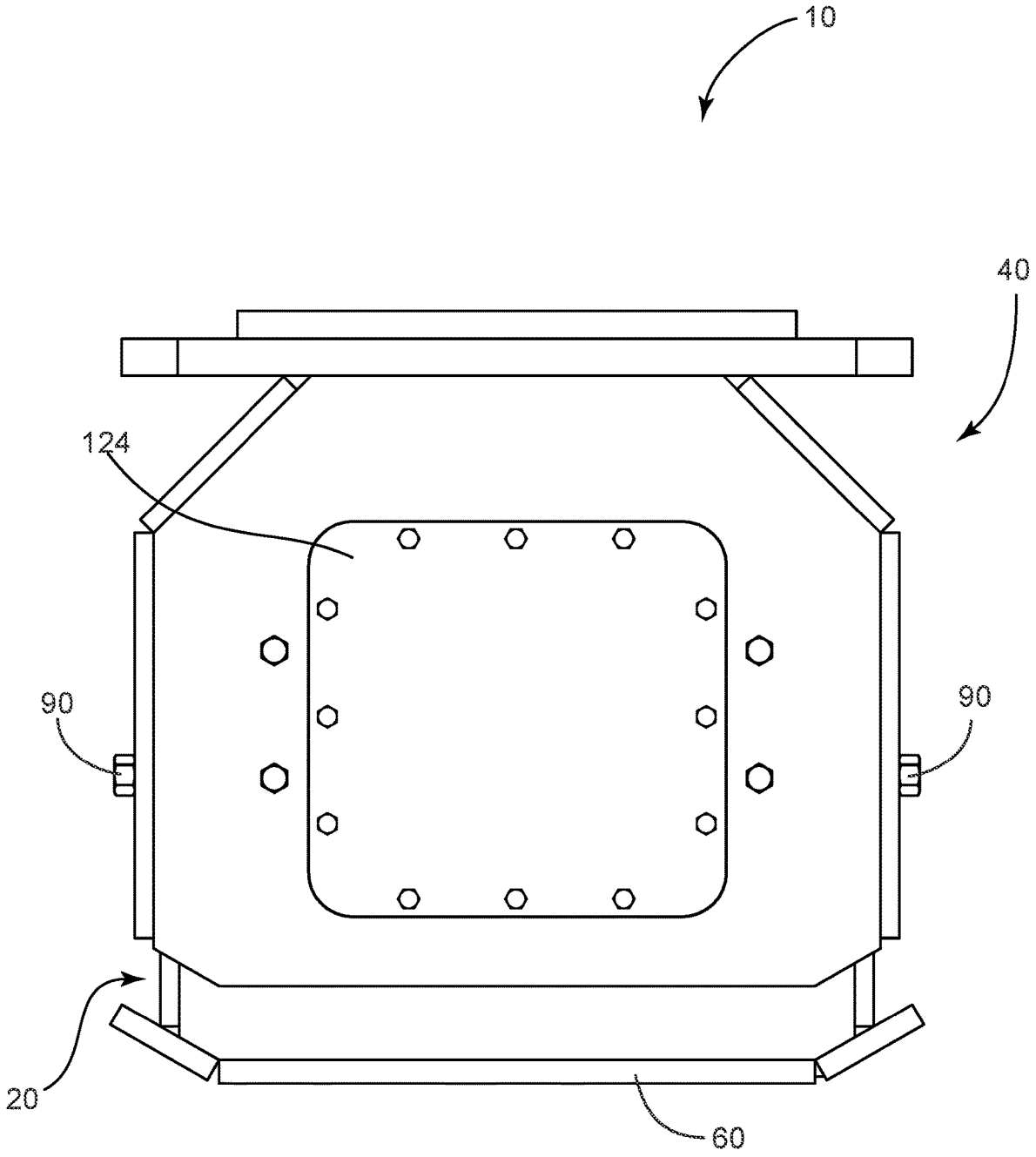
FIG. 3A is a side view of a vibratory compactor in accordance with an embodiment.
Figure 3B:
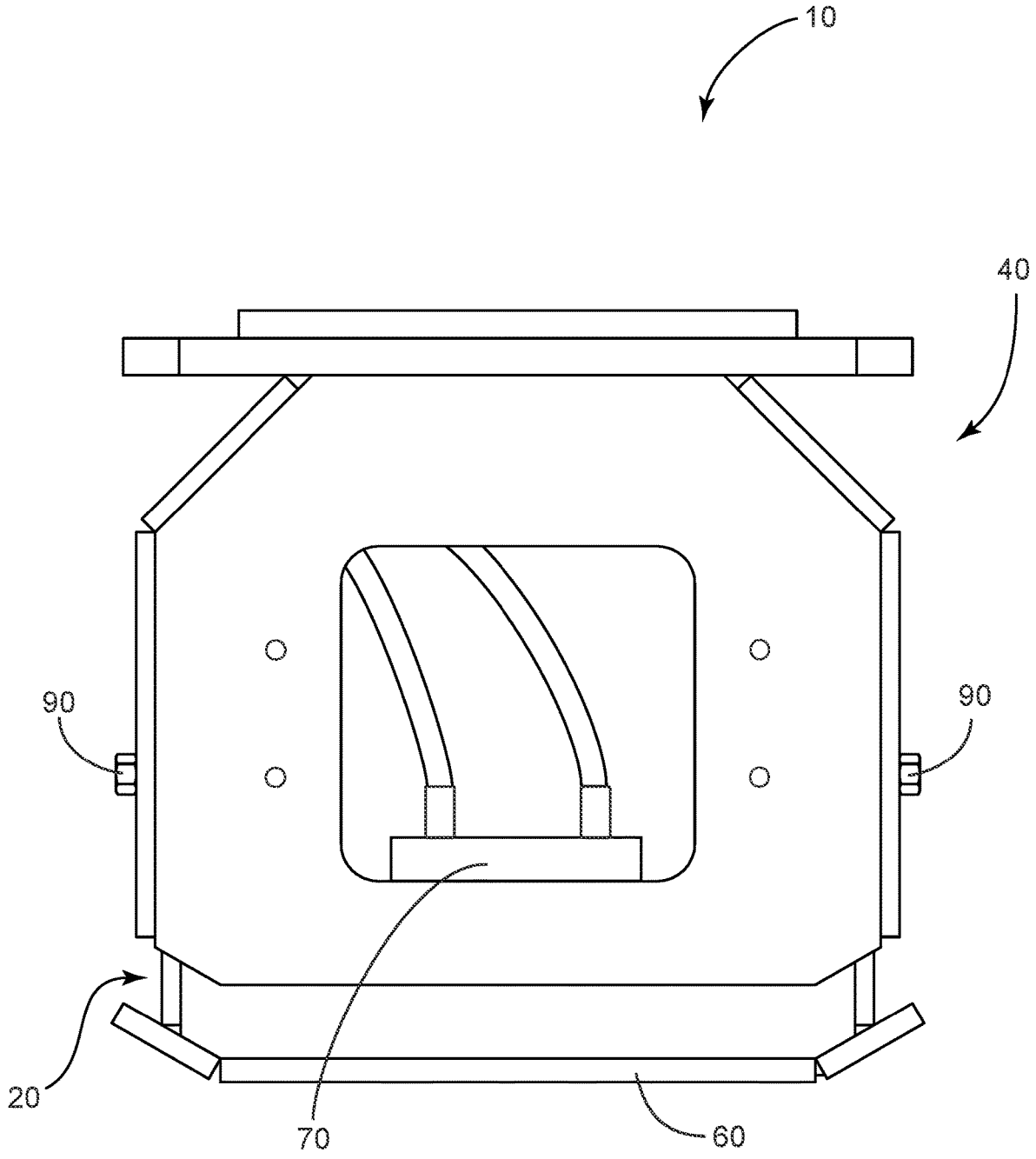
FIG. 3B is a side view of a vibratory compactor with a cover plate removed in accordance with an embodiment.
Figure 4:
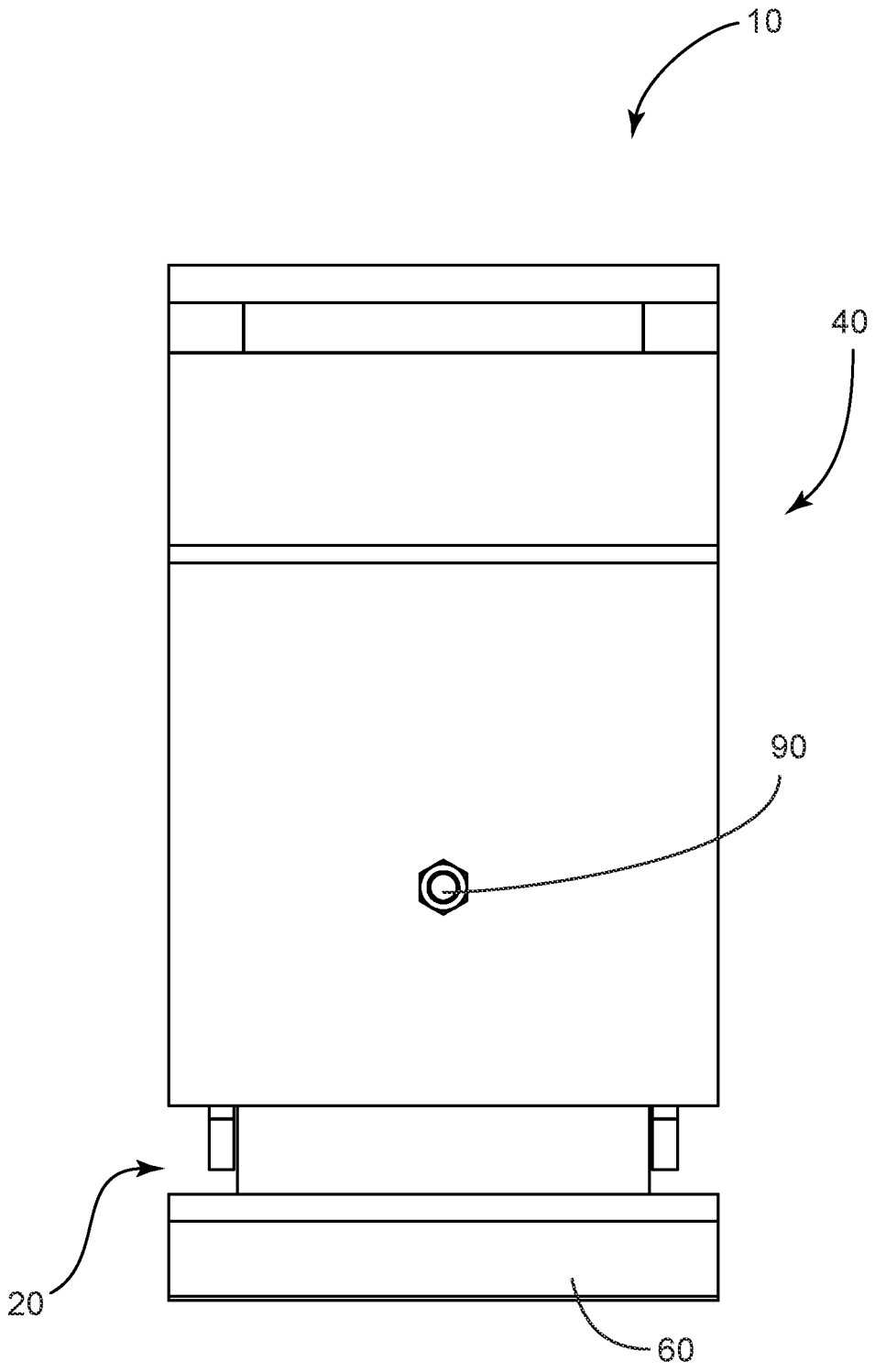
FIG. 4 is a front view with a front member of a housing removed from a vibratory compactor in accordance with an embodiment.
Figure 5:
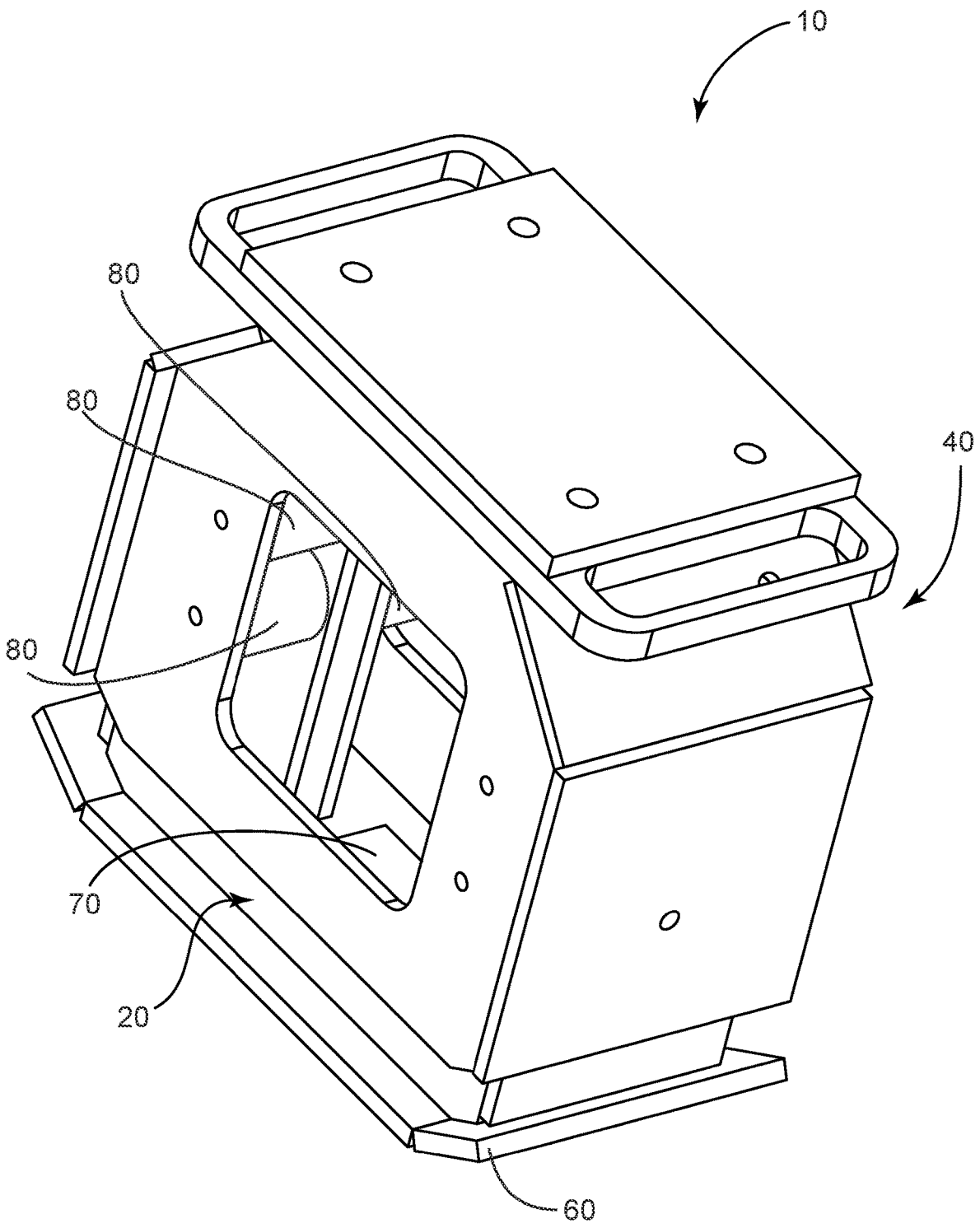
FIG. 5 is another perspective view of a vibratory compactor in accordance with an embodiment.

As discussed above, embodiments of the present invention relate to a vibratory compactor for use with an excavator type vehicle. An excavator type vehicle may be an excavator, a backhoe, a mini-excavator, or the like.

Referring to FIGS. 1-10, an embodiment of a vibratory compactor 10 is shown. The compactor 10 comprises a frame 20, a housing 40, a compactor plate 60 and a vibration generation device 70. The frame 20 comprises a first side member 22 spaced apart from a second side member 24 and a front member 28 spaced apart from a rear member 27, wherein the side members 22 and 24 with the front member 28 and the rear member 27 are coupled together to form a rectilinear inner space 32. The frame 20 may further comprise a plurality of mounting brackets 26 coupled between the first side member 22 and the second side member 24 and the between the front member 28 and the rear member 27. It will be understood that various amounts of mounting brackets 26 and orientations of coupling the mounting brackets 26 may be utilized. Further, it will be understood that the size and/or number of mounting brackets 26 utilized may correspond with the size of the vibratory compactor 10. The frame 20 may be coupled to the compactor plate 60. The vibration generation device 70 may be coupled to the compactor plate 60 within the inner space 32 of the frame 20. In embodiments, the vibration generation device 70 may be coupled directly to the compactor plate 60. The compactor plate 60 may include apertures wherein a larger compactor plate may be coupled to a bottom of the compactor plate 60.

The housing 40 may include a top member 42, chamfered members 45 and 46, a first side member 47, a second side member 49, a rear member 50 and a front member 52 coupled together to form the housing 40 with an open end providing access to an inner volume 54. The opening and inner volume 54 are configured to receive the frame 20 within the inner volume 54 of the housing 40. All of the holes for coupling components to each may be tapped holes and comprise threads. This allows for coupling of components together without the need of nuts. For example, and without limitation, the top member 42 of the housing 40 includes various amounts of threaded holes that are configured to allow various sized couplers (ears) to be coupled to or bolted to the top member 42 without the need for nuts.

The vibratory compactor 10 may further comprise a plurality of isolators 80. Each isolator 80 may be coupled to one mounting bracket of the plurality of mounting brackets 26 on one end and to a side member 47 or 49 of the housing 40 on the other end. A portion of each isolator 80 is within the inner space 32 and a portion of each isolator 80 extends beyond edges of the first side member 22 and the second side member 24. The housing 40 may be coupled to the plurality of isolators 80, wherein the housing 40 comprises couplers 82 removably coupled to a top member 42 of the housing 40. The coupler 82 may be configured for coupling the vibratory compactor 10 to an excavator type vehicle.

In embodiments, the first side member 22 of the frame 20 may comprise an aperture 23 providing access to the inner space 32. The second side member 24 of the frame 20 may comprise an aperture 25 providing access to the inner space 32. After assembly, the apertures 23 or 25 may be covered with a cover plate 124. Additionally, in some embodiments, the first side member 22, the second side member 24, front member 28 and rear member 27 are coupled to the compactor plate 60 forming a dust/debris seal 34 to inhibit dust/debris from entering the inner space 32.

In embodiments, the vibration generation device 70 is a hydraulic vibration generation device. In these embodiments, the housing 40 may comprise apertures 44 configured for hydraulic hoses 72 to extend therethrough from the excavator type vehicle to the hydraulic vibration generation device 70. In other embodiments, the housing 40 may comprise fittings configured for hydraulic hoses to extend between the excavator type vehicle and one side of the fittings and configured for hydraulic hoses 72 to extend between an opposed side of the fittings and the hydraulic vibration generation device 70.

The fittings may be located in the same place as the apertures 44. For example, the fittings may be coupled within the apertures 44.

In each of these embodiments, the apertures 44 are located toward a top of the housing 40 and not extending out of any of the sides of the housing 40. For example, the apertures 44 may be located in one of the upper chamfered members 45 or 46. The apertures located toward a top of the housing and not extending from the side, limits the opportunity for damage to the hoses or fittings. This is a distinction over prior art wherein prior art has hoses and fittings open to the environment and allows for damage to easily occur to the hoses and/or fittings. In embodiments of this invention, the fittings for hoses to the vibration generation device 70 are located within the inner space 32 of the frame 20 and the apertures 44 with or without fittings are located in an upper surface that limits damage that may occur during use. The configuration of the frame 20 and the housing 40 operate to protect the hoses 72 and fittings for operation of the vibration generation device 70. Additionally, the top member 42 of the housing 40 may include handles 43. The handles 43 operate to lift the housing 40 for coupling to the frame 20 and to lift the vibratory compactor 10 if needed. Further still, the hoses 72 may extend from the apertures 44 and through the handle opening 41 and serves as a further protection from damage to the hoses 72 during operation of the vibratory compactor 10 (see FIG. 1).

With additional reference to the isolators 80, the plurality of isolators 80 isolate the vibration of the compactor plate 60 and frame 20 from the housing 40. Additionally, the plurality of isolators 80 are oriented to allow forces to be applied to vibratory compactor 10 from operation of the excavator type vehicle in one or more directions comprising perpendicular to the compactor plate 60 and any angle to the compactor plate 60. As shown, the isolators may be cylindrical in shape and more than one isolator may be coupled to one bracket member 26 and the housing 40. It will be understood that as shown, the bracket members 26 may be elongate members with apertures that are configured to couple isolators 80 in parallel configuration on the same side of the bracket member 26. The vibratory compactor 10 may further comprise a gap 48 between the housing 40 and the frame 20 and the housing 40. The gap 48 allows for movement between the housing and the frame and the isolators operate to dampen the movement of the housing 40 during vibration of the plate 60 and the frame 20 when the vibratory compactor 10 is operating.

Figure 6A:
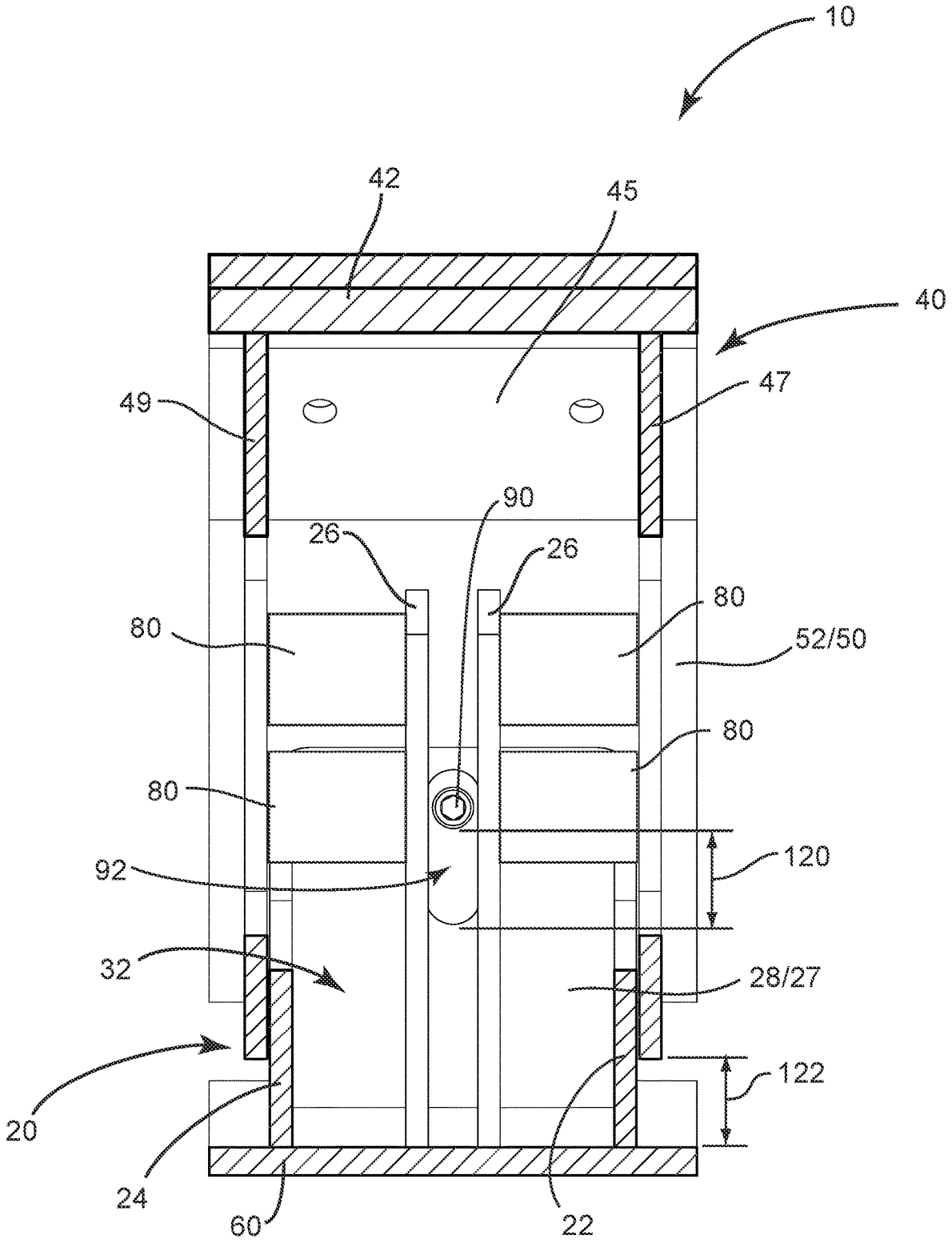
FIG. 6A is a section view of a vibratory compactor in accordance with an embodiment.
Figure 6B:
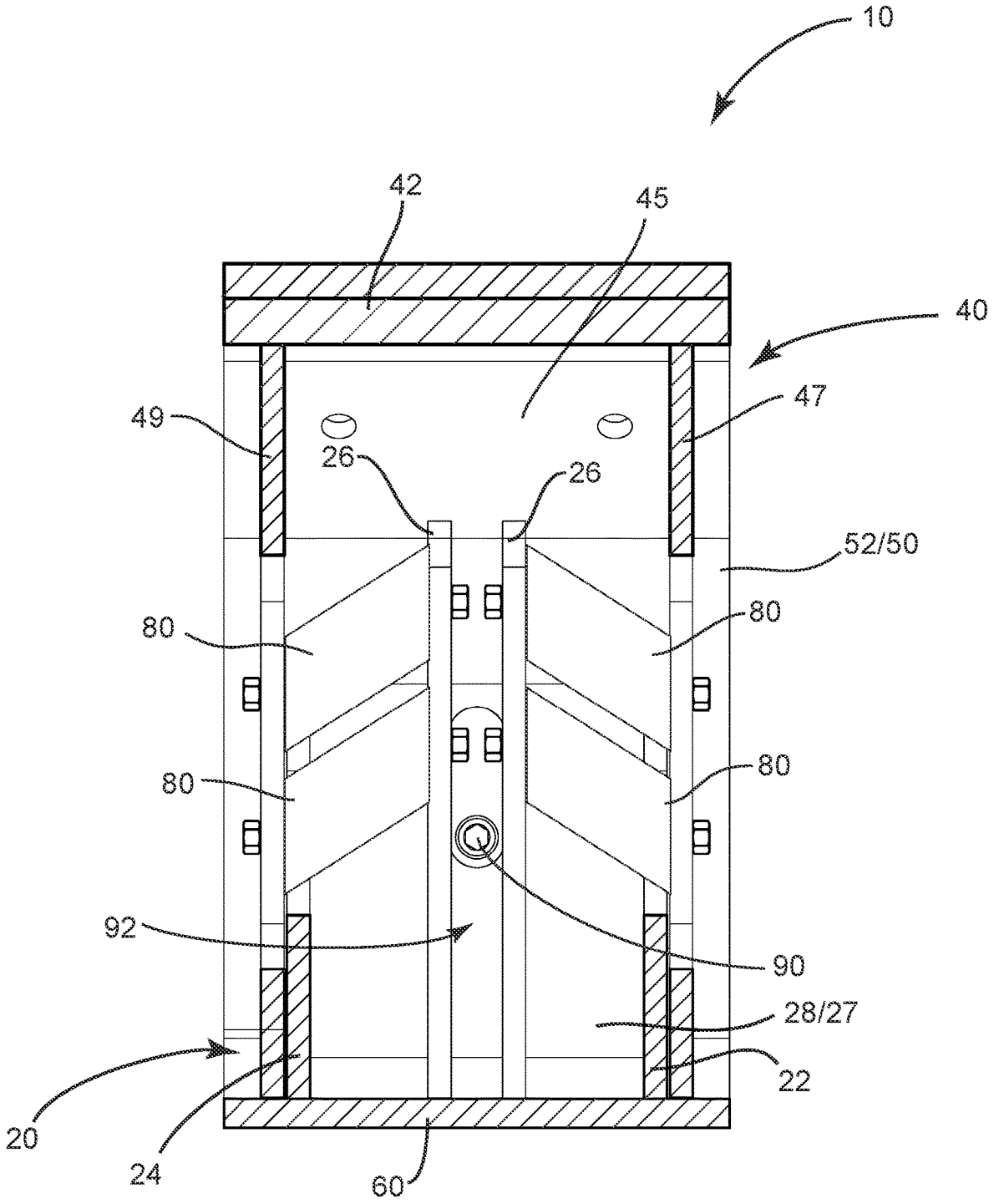
FIG. 6B is a section view of a vibratory compactor with a compressing force applied to the housing in accordance with an embodiment.
Figure 6C:
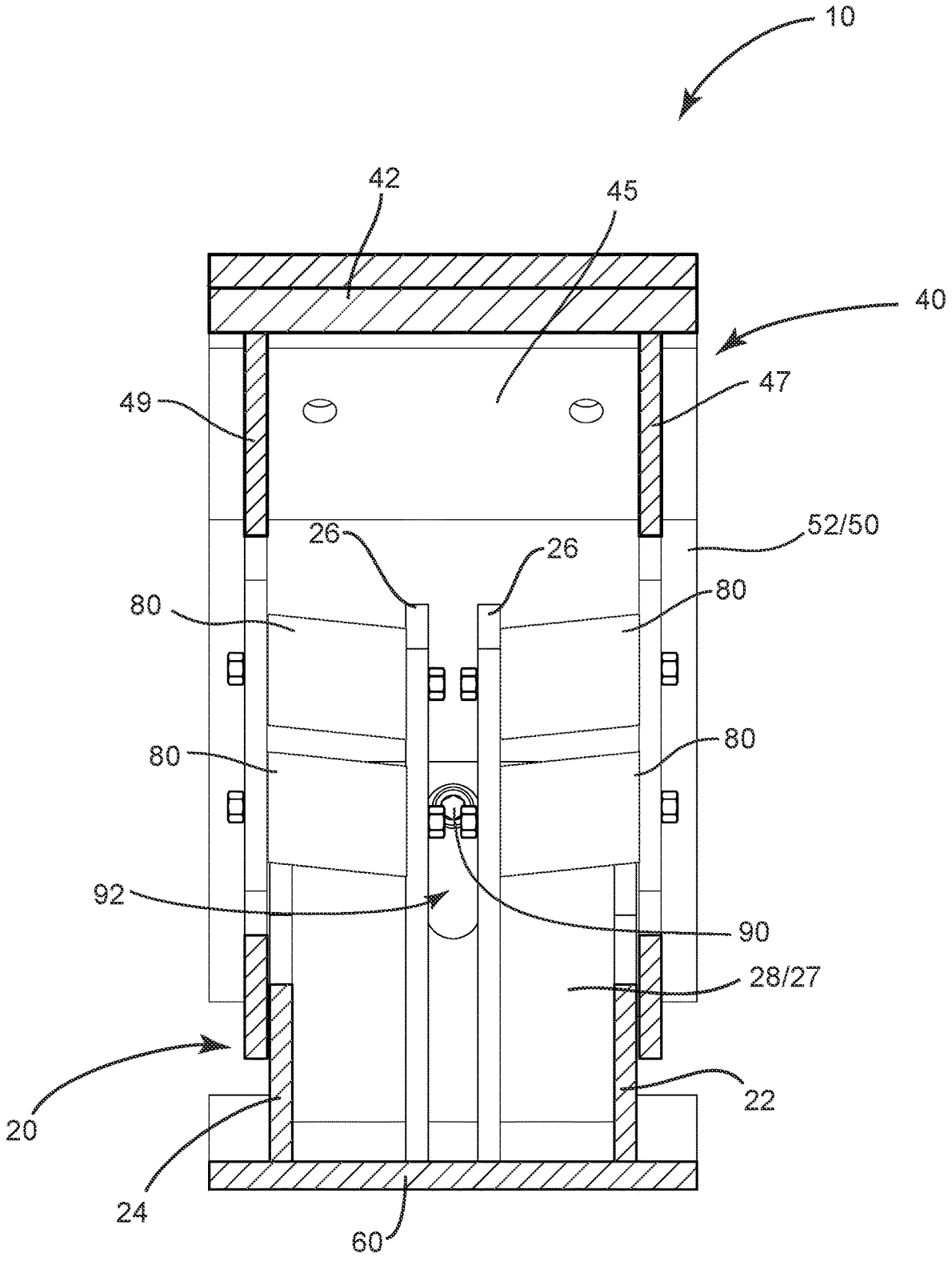
FIG. 6C is a section view of a vibratory compactor with a pulling force applied to the housing in accordance with an embodiment.
Figure 7:
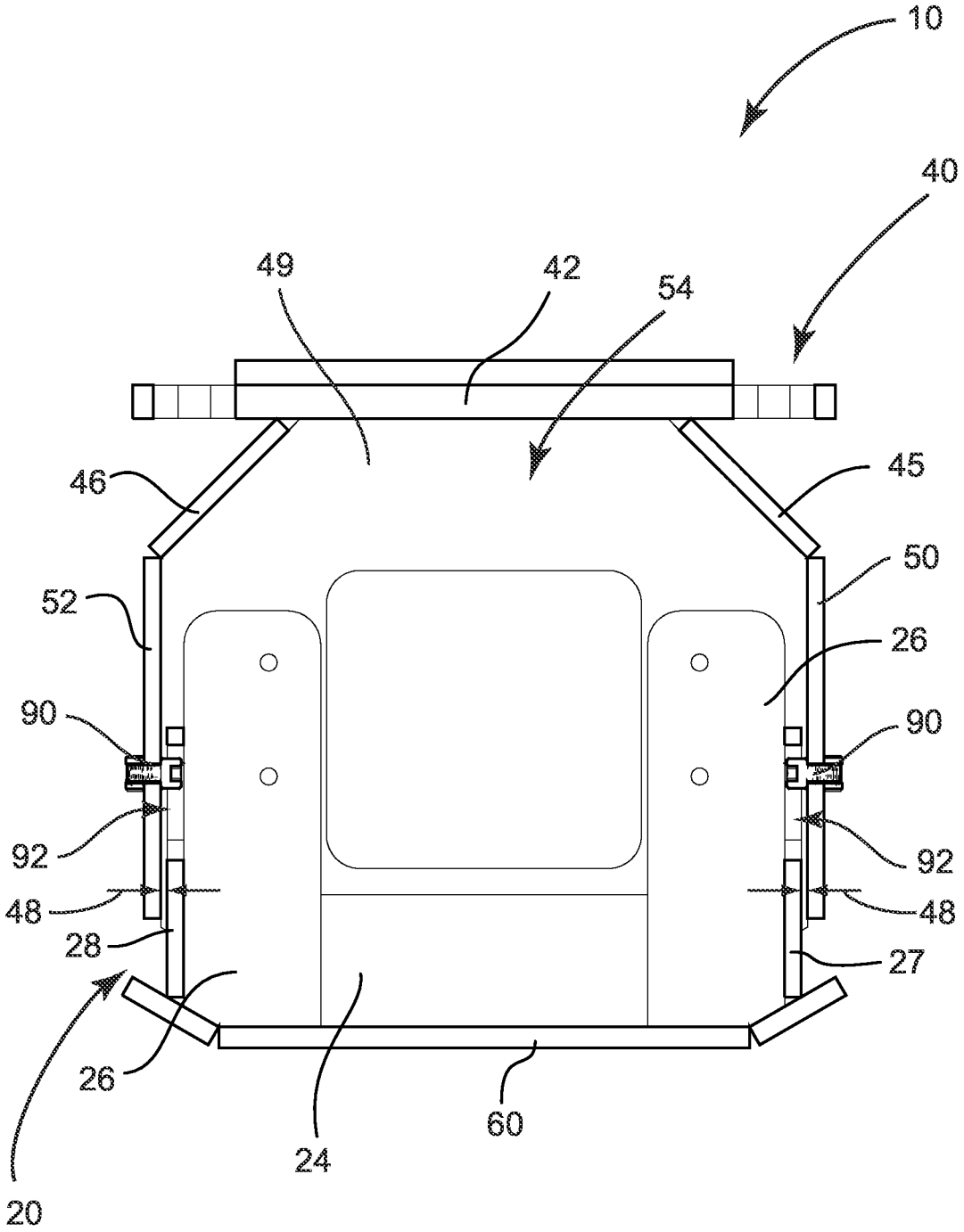
FIG. 7 is another section view of a vibratory compactor in accordance with an embodiment.

The front member 52 and the rear member 50 of the housing 40 may include apertures with control members 90, such as bolts, coupled through the apertures. The front member 28 and the rear member 27 of the frame 20 may include an elongate aperture 92 formed through the front member 28 and the rear member. Referring to FIGS. 6A-6C, the location of the elongate aperture 92 that allows the control member 90 to extend within the elongate aperture 92 with the housing 40 coupled to the frame 20 with isolators 80. The location of the control member 90 within the elongate aperture 92 is such that there is a predetermined distance 120 between a bottom end of the control member 90 and the bottom end of the elongate aperture 92 (see FIG. 6A). There is also a predetermined housing-plate gap 122 formed between a bottom of the housing 40 and the compactor plate 60 (See FIG. 6A). The length of distance 120 is greater that the length of the housing-plate gap 122. Accordingly, when force is applied to the compactor from above the housing 40 such as by an excavator operating the vibratory compactor 10, the housing 40 will contact the plate 60 before the control member 90 contacts the bottom surface of the elongate aperture 92.

Further, as an excavator operates to lift the vibratory compactor 10, such as from out of a ditch, if the compactor plate 60 or other component coupled to the compactor plate 60 gets caught on some object that inhibits lifting of the vibratory compactor 10, the control member 90 and the elongate aperture 92 operate to protect damage to the vibratory compactor 10. The control member 90 will move with the housing 40 as an upward force is applied on the housing 40. The compactor plate 60 and frame 20 would not move due to the contact with an obstruction to movement of the compactor plate 60. As the housing 40 moves with respect to the frame 20, the control member moves within the elongate aperture 92 until is contacts the top surface of the elongate aperture 92, as shown in FIG. 6C. This inhibits movement of the housing 40 with respect to the frame 20 and prevents damage to the isolators 80, the frame 20 and the housing 40 that may result from continued pulling on the housing 40 with the compactor plate 60 and the frame 20 in a fixed non-moving state.

It will be understood that while one size of a vibratory compactor 10 is depicted in the drawings figure, the vibratory compactor may be made in any number of various sizes depending on the type of job and the size of excavator type vehicle may be using the vibratory compactor 10. In some embodiments, particularly as the size of the vibratory compactor increases, the gap 48 may be of a size that the vibratory compactor 10 may comprise a spacer between the frame 20 and the housing 40. The spacer may be formed of ultra high molecular weight polyethylene ("UHMW") or other type of material with comparable material attributes to UHMW. Typically, the spacer is located between the frame 20 and the first and second side members 47 and 49 of the housing 40. The spacer may operate as an additional debris seal.

Figure 9:
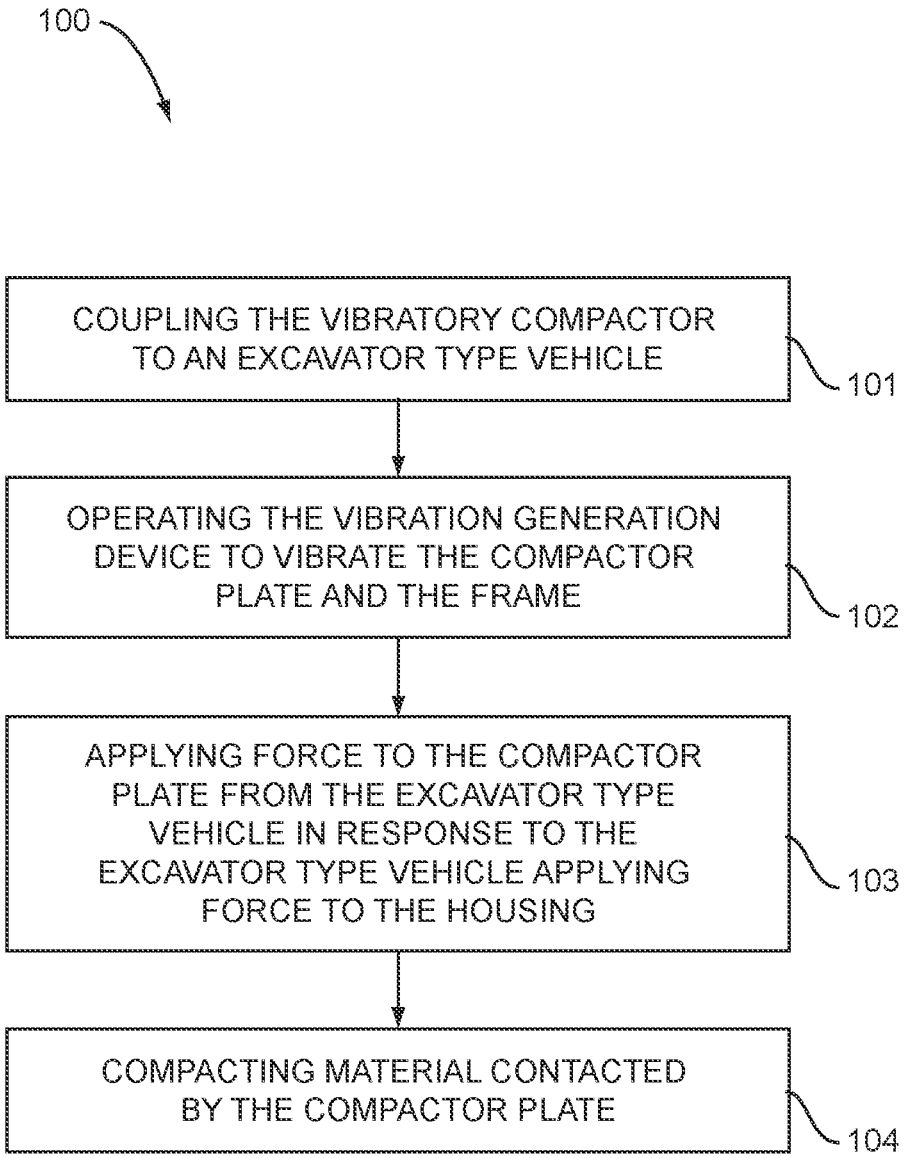
FIG. 9 is flow chart of a method of using a vibratory compactor in accordance with an embodiment.
Figure 10:
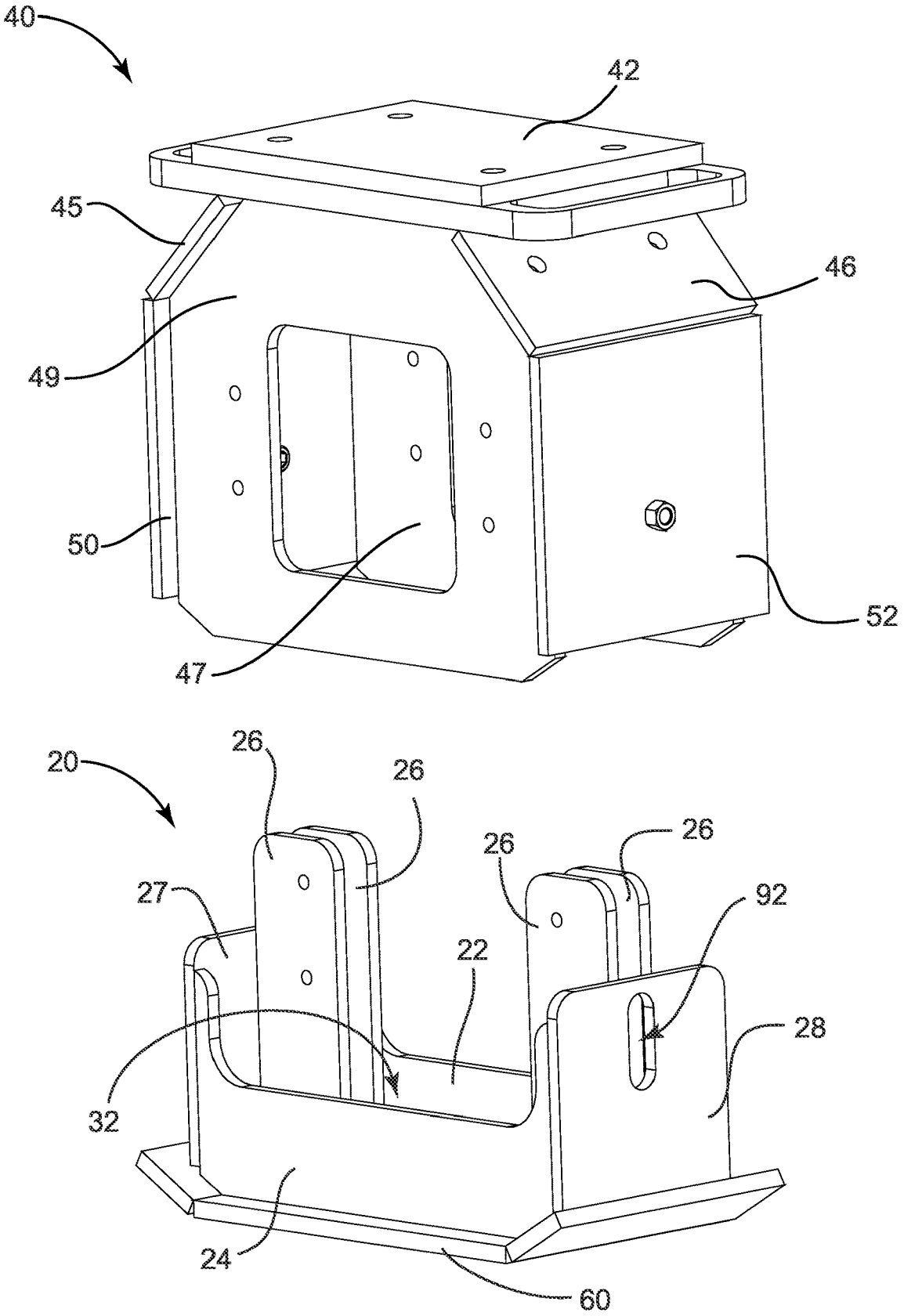
FIG. 10 is an exploded perspective view of a vibratory compactor in accordance with an embodiment.

Referring further to the drawings, FIG. 9 depicts a method 100 of using vibratory compactor. The method 100 may comprise coupling the vibratory compactor to an excavator (Step 101), wherein the vibratory compactor comprises the components as described above; operating the vibration generation device to vibrate the compactor plate and the frame (Step 102); applying force to the compactor plate from the excavator type vehicle in response to the excavator type vehicle applying force to the housing (Step 103); and compacting material contacted by the compactor plate (Step 104).

The method 100 may further comprise isolating vibration of the compactor plate and the frame from the housing. Additionally, the Step 102 of operating the vibration generation device may comprise flowing hydraulic fluid through the vibration generation device.

Figure 8A:
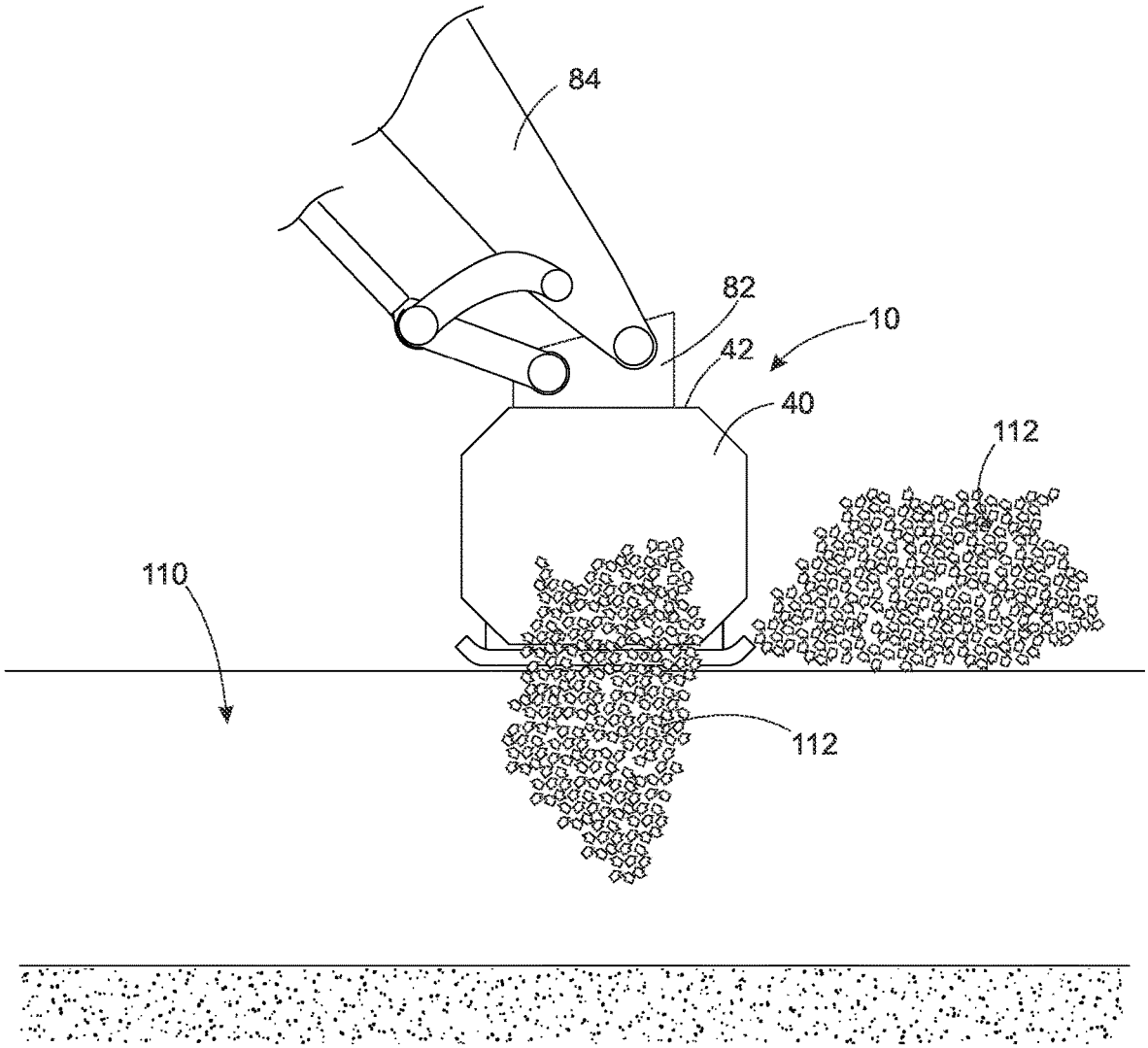
FIG. 8A is a side view of a ditch with a vibratory compactor moving material from a side of the ditch into the ditch in accordance with an embodiment.
Figure 8B:
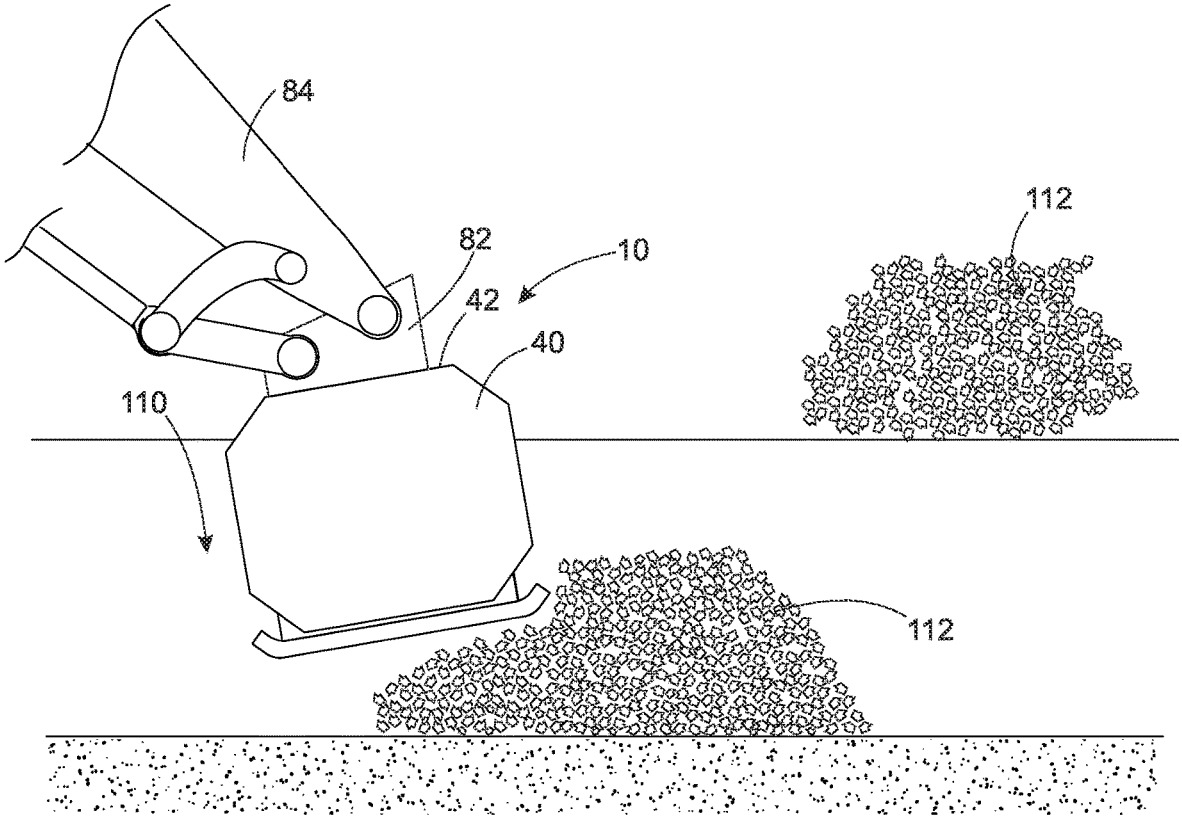
FIG. 8B is a side view of a ditch with a vibratory compactor moving material within the ditch in accordance with an embodiment.
Figure 8C:
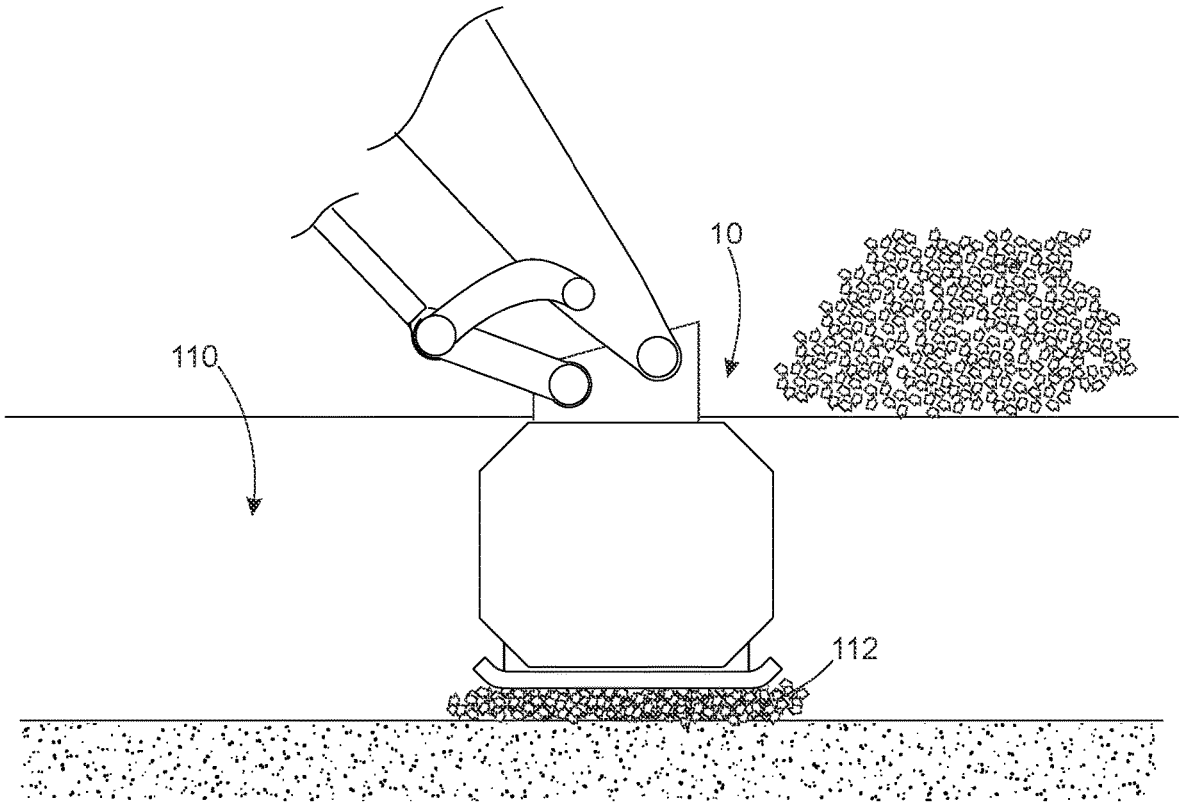
FIG. 8C is a side view of a ditch with a vibratory compactor compacting material within the ditch in accordance with an embodiment.

With further reference to FIGS. 8A-8C, the method of use may include moving material 112 from a first location to a second location, moving material in the second location and compacting material in the second location. A typical example of this is back filling and leveling a ditch that has rocky material within it. For example and without limitation, a first location may be a side of a ditch 110 to a second location within the ditch 110 with the vibratory compactor 10 as shown in FIG. 8A; moving material within the ditch 110 with the vibratory compactor 10 as shown in FIG. 8B; and compacting the material 112 within the ditch 110 as depicted in FIG. 8C. In each instance the vibratory compactor 10 may utilize couplers 90 to couple to an arm 92 of an excavator type vehicle and operate to move or scrape material from a side of the ditch 110 into the ditch 110, move material within the ditch 110 and compact the material within the ditch 110. Conventional compactors do not have the ability to perform either of these functions because the hoses, fittings and motor are all exposed and subject to damage just by trying to compact within the ditch 110 and would definitely lack the ability to scrape material into the ditch.

During operation of back filling and leveling a ditch, as described above, the method may include inhibiting movement of housing with respect to the frame by use of the control member 90 and the elongate aperture 92. This movement may be inhibited as described above with respect to FIG. 6C and provides a method of preventing damage to the isolators 80.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed.

Many modifications and variations are possible in light of the teachings above without departing from the spirit and scope of the forthcoming claims.

The invention claimed is:

1. A vibratory compactor comprising:

a compactor plate;

a frame having a front member and a rear member coupled directly to the compactor plate,
wherein the frame comprises:
an inner space within the frame;
more than one mounting bracket coupled within the inner space of the frame; and
an elongate aperture formed in each the front member of the frame and the rear member of the frame;

a hydraulic vibration generation device coupled to the compactor plate within the inner space of the frame; and a housing having a front member, a rear member and two side members, the housing coupled to the frame through isolators coupled between the more than one mounting bracket and the two side members, the frame located within an inner volume of the housing and forming a gap between the frame and the housing, wherein:

the housing further comprises a first control member coupled through an aperture in the front member of the housing and a second control member coupled through an aperture in the rear member of the housing;

the first control member extends within the elongate aperture in the front member of the frame and the second control member extends within the elongate aperture in the rear member of the frame when the housing is coupled to the frame; and the first and second control members and the elongate apertures operate independently to limit upward movement of the housing with respect to the frame to prevent damage to the isolators.

2. The vibratory compactor of claim 1, wherein the isolators isolates the vibration of the compactor plate and frame from the housing.

3. The vibratory compactor of claim 1, wherein the isolators are oriented to allow forces to be applied to the vibratory compactor from operation of an excavator type vehicle in one or more directions comprising perpendicular to the compactor plate and any angle to the compactor plate.

4. The vibratory compactor of claim 1, wherein the first control member contacts a top surface of the elongate aperture in the front member of the frame or the second control member contacts a top surface of the elongate aperture in the rear member of the frame in response to the compactor plate or the frame being restricted from moving up while the housing is not restricted, the contact of the first control member with the top surface of the elongate aperture in the front member of the frame or the contact of the second control member with the top surface of the elongate aperture in the rear member of the frame limiting movement of the housing with respect to the frame.

5. The vibratory compactor of claim 4, wherein damage to the isolators are prevented in response to limiting movement of the housing with respect to the frame.

6. The vibratory compactor of claim 1, wherein the housing comprises a top member having at least one handle with a handle opening.

7. The vibratory compactor of claim 6, wherein hydraulic hoses extending into the housing and coupled to the hydraulic vibration generation device extend through the handle opening of the at least one handle to protect the hydraulic hoses from damage during operation of the vibratory compactor.

8. A method of operating a vibratory compactor comprising:

coupling the vibratory compactor to a vehicle, the vibratory compactor comprising:

a compactor plate coupled to a frame;

a hydraulic vibration generation device coupled to the compactor plate;

a housing coupled around the frame with isolators coupled between mounting brackets of the frame and side walls of the housing; and a first control member coupled to a front member of the housing and a second control member coupled to a rear member of the housing, wherein the first control member extends within an elongate aperture in a front member of the frame and the second control member extends within an elongate aperture in a rear member of the frame; and inhibiting upward movement of the housing with respect to the frame through independent operation of the first control member and the second control member in response to the compactor plate or frame being restricted while lifting the vibratory compactor.

9. The method of claim 8, further comprising isolating the vibration of the compactor plate and frame from the housing.

10. The method of claim 8, further comprising preventing damage to the isolators in response to inhibiting movement of the housing with respect to the frame.

11. The method of claim 8, further comprising during operation of the vibratory compactor, protecting hydraulic hoses extending into the housing and coupled to the hydraulic vibration generation device in response to extending the hydraulic hoses through a handle opening of at least one handle of the housing.

* * * * *